United States Patent [19]

Cantlin

[11] 4,295,016

[45] Oct. 13, 1981

[54] GARAGE DOOR LOCK

[75] Inventor: John H. Cantlin, Lincoln, Mass.

[73] Assignee: Hudson Lock, Inc., Hudson, Mass.

[21] Appl. No.: 103,532

[22] Filed: Dec. 14, 1979

[51] Int. Cl.[3] ..... H01H 27/06

[52] U.S. Cl. ..... 200/44

[58] Field of Search ..... 200/116 G, 11 J, 116 K, 200/42 R, 44, 243

[56] References Cited

U.S. PATENT DOCUMENTS

| | | | |
|---|---|---|---|
| 2,517,506 | 8/1950 | Riggs | 200/44 |
| 2,613,288 | 10/1952 | Brown | 200/44 |
| 3,013,129 | 12/1961 | Root | 200/11 J |
| 3,345,489 | 10/1967 | Kemnitz | 200/321 |
| 3,639,708 | 2/1972 | Wolniak | 200/44 |

FOREIGN PATENT DOCUMENTS

| | | | |
|---|---|---|---|
| 972668 | 9/1959 | Fed. Rep. of Germany | 200/116 G |

*Primary Examiner*—John W. Shepperd
*Attorney, Agent, or Firm*—John E. Toupal

[57] ABSTRACT

The invention is a lockable electrical switch including a cylindrical plug mounted within a shell for rotary movement between locked and unlocked positions and for axial movement between active and inactive positions, the plug defining a keyway and a plurality of tumblerways intersecting therewith. Residing in the tumblerways are tumblers that operatively engage the shell and the plug so as to prevent relative rotation therebetween in the absence of a proper key in the keyway. A movable contact is mounted for movement with the plug and a stationary contact is shaped and arranged so as to be engaged by the movable contact with the plug in both its unlocked and active positions but to be disengaged therefrom with the plug in either of its locked or inactive positions. Closure of the switch by engagement of the contacts requires the use of a key to rotate the plug into an unlocked position.

9 Claims, 4 Drawing Figures

GARAGE DOOR LOCK

BACKGROUND OF THE INVENTION

This invention relates generally to a lockable electrical switch and, more particularly, to a lockable, plunger type electrical switch for controlling motorized garage door openers.

Motorized transport mechanisms are used extensively to control the opening and closing of garage doors. Frequently, the electrical systems of such devices are energized by lock actuated switches that limit access to the door-equipped enclosure. Although they usually simplify the process of entry into a locked garage, such mechanisms do cause inconvenience under certain circumstances. For example, an absentee occupant of a dwelling having a switchlock controlled garage door sometimes desires to provide garage access to service personnel, tradesmen, etc., but does not wish to compromise future security by furnishing a key thereto. Also, while engaged in activities outside, an occupant often desires entry to a locked garage which entails a burdensome requirement that he have immediate possession of a key.

The object of this invention, therefore, is to provide a secure garage door opener lock that can be selectively operated either with or without a key.

SUMMARY OF THE INVENTION

The invention is a lockable electrical switch including a cylindrical plug mounted within a shell for rotary movement between locked and unlocked positions and for axial movement between active and inactive positions, the plug defining a keyway and a plurality of tumblerways intersecting therewith. Residing in the tumblerways are tumblers that operatively engage the shell and the plug so as to prevent relative rotation therebetween in the absence of a proper key in the keyway. A movable contact is mounted for movement with the plug and a stationary contact is shaped and arranged so as to be engaged by the movable contact with the plug in both its unlocked and active positions but to be disengaged therefrom with the plug in either of its locked or inactive positions. Closure of the switch by engagement of the contacts requires the use of a key to rotate the plug into an unlocked positions. In that position the key can be removed and switch closure accomplished by a manually induced axial movement of the plug from its inactive to its active position. After release of manual pressure, a bias spring opens the switch by returning the plug to its inactive position.

According to particular features of the invention, the stationary contact comprises a pair of spaced apart terminals and the movable contact is an elongated contact having a length that bridges the terminals with the plug in the unlocked position and a width that is straddled by and laterally spaced from the terminals with the plug in the locked position. Because of an axial misalignment between the contacts, forcible movement of the locked plug into its active position will not result in switch closure.

According to another feature of the invention, the stationary contact includes an insulator body that defines an internal cavity retaining the terminals and an opening communicating with the cavity. The opening has a periphery with dimensions that permit entry of the elongated contact with the plug in the unlocked position and obstruct entry thereof with the plug in the locked position. Engagement between the movable contact and the insulator body prevents axial movement of the locked plug into its active position.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
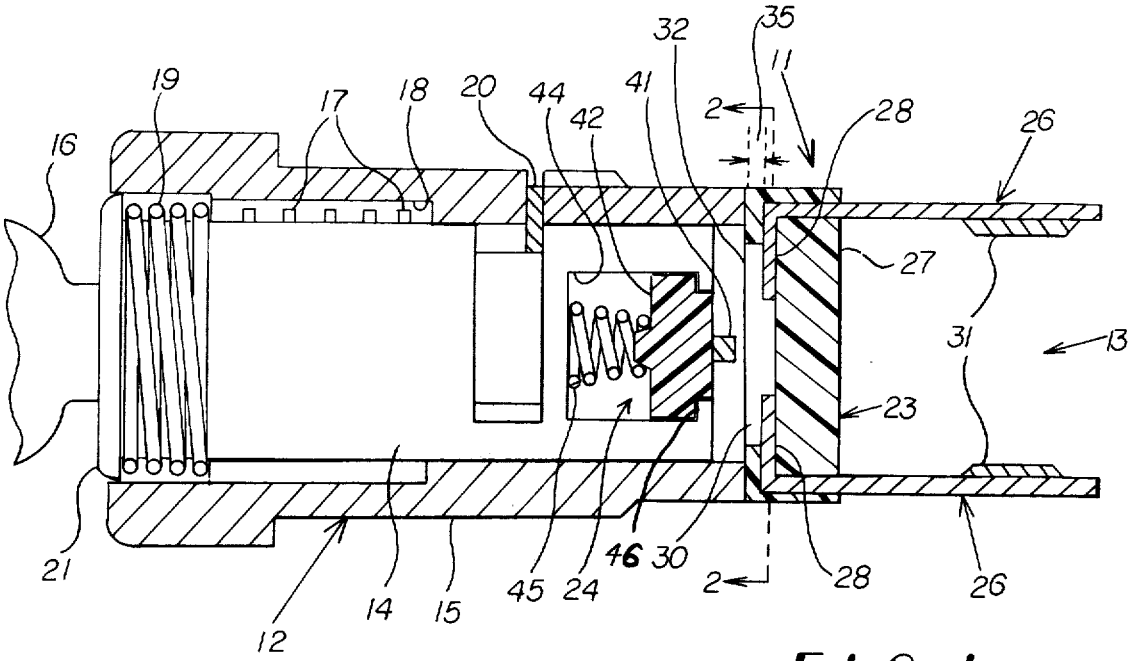
FIG. 1 is a schematic cross-sectional view of a lockable switch according to the invention shown in a locked position.
Figure 2:
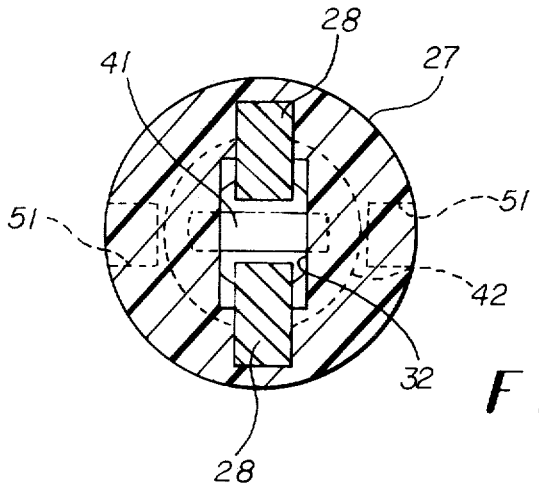
FIG. 2 is a cross-sectional view taken along the lines 2—2 of FIG. 1.
Figure 3:
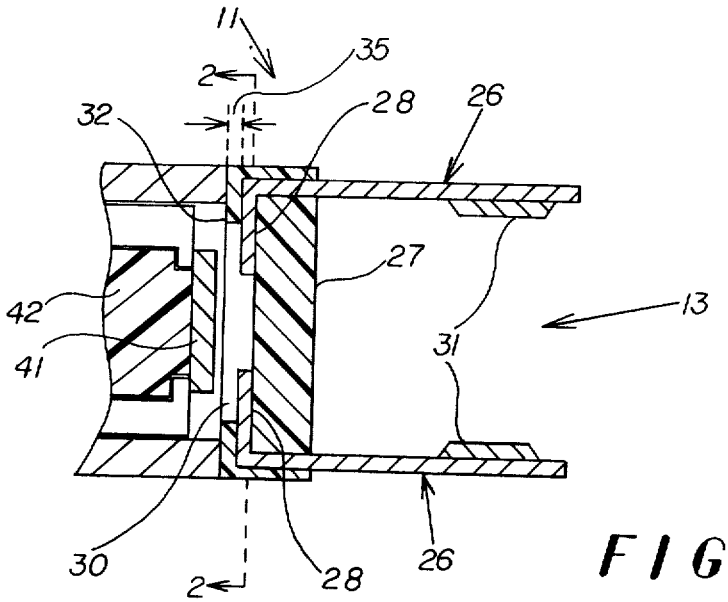
FIG. 3 is a partial cross-sectional view of the lock shown in its unlocked and inactive positions.
Figure 4:
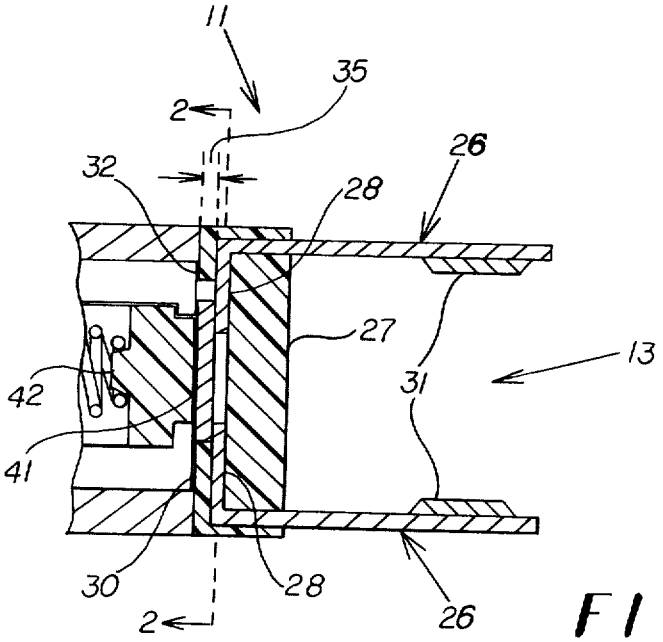
FIG. 4 is a schematic cross-sectional view of the lock shown in its unlocked and active positions.

Referring now to FIG. 1, there is shown a lockable switch assembly 11 according to the invention. Preferably, the switch 11 would be used to control energization of a motorized garage door opener (not shown). The assembly 11 includes a plunger lock portion 12 and a switch portion 13. Forming the lock portion 12 is a cylindrical plug 14 mounted within a shell 15. The plug 14 defines a plurality of tumblerways (not shown) that intersect a keyway (not shown) for receiving a key 16. Retained by the tumblerways are a plurality of wafer tumblers 17 that normally engage a locking spline 18 in the shell 15 to prevent 90° rotation of the plug 14 from a locked position as shown in FIGS. 1 and 2 to an unlocked position as shown in FIGS. 3 and 4. The plug 14 also can undergo reciprocal axial movement within the shell 15 between the inactive position shown in FIG. 1 to an active position shown in FIG. 4. Positioned between the shell 15 and an outer shoulder portion 21 of the plug 14 is a bias spring member 19 that urges the plug 14 toward its inactive position. A pin 20 prevents removal of the plug 14 while permitting inward movement thereof. Specific details of the lock portion 12 are conventional and of the type, for example, shown in U.S. Pat. Nos. 4,009,599 and 2,046,831.

The switch portion 13 comprises a stationary contact assembly 23 and a movable contact assembly 24. Included in the stationary contact assembly 23 is a pair of L-shaped terminals 26 retained by an insulator body 27 secured to an inner end of the shell 15. As shown in FIG. 1, the terminals 26 include base portions 28 spaced apart in a cavity 30 within the insulator block 27 and leg portions 29 that terminate with tabs 31 suitable for connection into an electrical circuit. Defined by a rectangularly shaped, peripheral edge 32 (as shown in FIG. 2) is an opening in the insulator body that communicates with the cavity 30. The base portions 28 of the electrode terminals 26 are spaced from the periphery 32 by an air gap 35 that prevents an electrical breakdown between the terminals 26 via a spaced contact 41.

The movable contact assembly 24 includes the elongated contact 41 extending from and secured to a circular insulator body 42. The body 42 is retained within a cavity 44 in the plug 14 between a spiral spring member 45 and a re-entrant plug portion 46. The coupling spring member 45 insures that both rotary and axial movement of the plug 14 is transmitted to the elongated contact 41 but permits a small degree of axial orientation therebetween.

With the plug 14 in the locked position of FIG. 1, the elongated contact 41 is out of engagement with the base portions 28. Therefore, no circuit is completed between the terminals 26. Furthermore, as shown in FIG. 2, the rectangularly shaped opening 32 is transverse to the elongated contact 41 so as to prevent entry thereof into the cavity 30. Thus any attempt to force the plug 14 inwardly in the shell 15 results in engagement of the contact 41 with the outer surface of the insulator body 27 and thereby prevents closure of the switch. Any inward movement of the plug 14 when in its locked position merely results in engagement between the contact 41 and the insulator body 27 producing relative axial movement between the insulator body 42 and the plug 14 via the orientation spring 45. To further insure against closure of the switch with the plug in its locked position, the elongated contact 41 is straddled by and transversely spaced from the base portions 28 as shown in FIG. 2.

With a proper key 16 in the lock 12, the wafers 17 are positioned at shear levels out of engagement with the spline 18. Consequently, the plug can be rotated 90° within the shell 15 to an unlocked position. Corresponding movement of the movable contact assembly 24 produces alignment between the contact 41 and the opening 32. However, as shown in FIG. 3, the bias spring 19 maintains the contact 41 in an inactive axial position spaced from the base portions 28 by the air gap 35. Thus, switch closure does not occur and a door-closing circuit (not shown) connected to the buttons 31 remains de-energized. It will be noted in FIG. 2 that the shell 15 defines opposed splines 51 that align with the wafers 17 with the plug 14 in its 90° unlocked position. Thus, the key 16 can be removed from the lock 12 with the plug 14 unlocked.

When door activation is desired, the unlocked plug 14 is pressed inwardly against the bias of the spring member 19. Because of the alignment between the contact 41 and the opening 32, the contact is able to enter the cavity 30 and engage both of the base portions 28. Thus, a circuit is completed between the terminals 26 and a door control circuit (not shown) connected thereto is energized. A good contact between the contact 41 and both of the base portions 28 is insured by the coupling spring 45. After initial engagement between the contact 41 and either of the base portions 28, the spring permits the insulator body to tilt slightly with respect to the axis of the shell 15 and thereby induce engagement with both base portions 28.

Obviously, many modifications and variations of the present invention are possible in light of the above teachings. It is to be understood, therefore, that the invention can be practiced otherwise than as specifically described.

What is claimed is:

1. A lockable electrical switch comprising:

a lock shell;

a cylindrical plug mounted within said shell for rotary movement between locked and unlocked positions and for axial movement between active and inactive positions, said plug defining a keyway and a plurality of tumblerways intersecting therewith;

tumbler means movably mounted in said tumblerways, said tumbler means operatively engaging said shell and said plug so as to prevent relative rotation therebetween in the absence of a proper key in said keyway;

a movable contact means mounted for movement with said plug; and stationary assembly means comprising stationary contact means shaped and arranged so as to be engaged by said movable contact means with said plug in both said unlocked and active positions and to be disengaged therefrom with said plug in either of said locked or inactive positions, said stationary assembly means further comprising an insulator body defining both an internal cavity retaining said stationary contact means and an opening communicating with said cavity, said opening having a periphery with dimensions that permit entry into said cavity of said movable contact with said plug in said unlocked position and obstruct entry thereof with said plug in said locked position.

2. A switch according to claim 1 wherein said shell is shaped and arranged such that a proper key is removable from said keyway with said plug in said unlocked position.

3. A switch according to claim 2 wherein said stationary contact means comprises a pair of terminals spaced apart in a direction transverse the axis of said plug, and said movable contact means comprises an elongated contact having a length that bridges said terminals with said plug in said unlocked position and a width that is straddled and transversely spaced from said terminals with said plug in said locked position.

4. A switch according to claim 3 wherein said elongated contact is axially spaced from said terminals with said plug in said inactive position.

5. A switch according to claim 4 wherein said terminals are spaced from said periphery by a predetermined air gap.

6. A switch according to claim 5 including bias means urging said plug toward said inactive position.

7. A switch according to claim 3 including a resilient coupling means operatively connecting said elongated contact and said plug, said coupling means permitting said elongated contact to tilt with respect to the axis of said plug.

8. A switch according to claim 1 wherein said stationary contact means are spaced from said periphery by a predetermined air gap.

9. A switch according to claim 8 wherein said shell is shaped and arranged such that a proper key is removable from said keyway with said plug in said unlocked position.

* * * * *